US007319294B2

(12) United States Patent
Golling

(10) Patent No.: US 7,319,294 B2
(45) Date of Patent: Jan. 15, 2008

(54) METAL HALIDE HIGH PRESSURE DISCHARGE LAMP

(75) Inventor: Hans-Werner Golling, Berlin (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 11/447,149

(22) Filed: Jun. 6, 2006

(65) Prior Publication Data

US 2006/0273727 A1 Dec. 7, 2006

(30) Foreign Application Priority Data

Jun. 7, 2005 (DE) ..... 10 2005 026 208

(51) Int. Cl.
*H01J 61/16* (2006.01)
*H01J 61/18* (2006.01)
*H01J 61/20* (2006.01)
*H01J 61/22* (2006.01)

(52) U.S. Cl. ..... 313/637; 313/638; 313/639; 313/640; 313/641

(58) Field of Classification Search ..... 313/637, 313/638, 639
See application file for complete search history.

(56) References Cited

U.S. PATENT DOCUMENTS

| | | | | |
|---|---|---|---|---|
| 3,911,308 | A * | 10/1975 | Akutsu et al. | 313/567 |
| 5,323,085 | A | 6/1994 | Genz | |
| 5,635,796 | A * | 6/1997 | Genz | 313/641 |
| 5,929,563 | A * | 7/1999 | Genz | 313/571 |
| 2003/0076041 | A1 * | 4/2003 | Honda et al. | 313/634 |
| 2003/0184231 | A1 * | 10/2003 | Eisemann | 313/640 |
| 2006/0220563 | A1 * | 10/2006 | Genz et al. | 313/641 |

FOREIGN PATENT DOCUMENTS

| | | |
|---|---|---|
| EP | 0 492 205 | 7/1992 |

* cited by examiner

*Primary Examiner*—Ashok Patel
(74) *Attorney, Agent, or Firm*—William E. Meyer

(57) ABSTRACT

In the metal halide high-pressure discharge lamp for stage, film and television lighting systems and for projection technology and effect lighting, the discharge vessel contains dysprosium and cesium as fill metals for the metal halides. Optimum results for dimmability, arc instability and color rendering are achieved if the fill additionally includes 0.12 to 3.8 μmol of vanadium and if appropriate 0.05 to 1.0 μmol of zirconium per ml of vessel volume. These metals achieve improved color rendering, in particular red rendering, with an Ra of from 70 to 95 and an $R_9$ of from 45 to 90.

8 Claims, 1 Drawing Sheet

METAL HALIDE HIGH PRESSURE DISCHARGE LAMP

TECHNICAL FIELD

Figure 1:
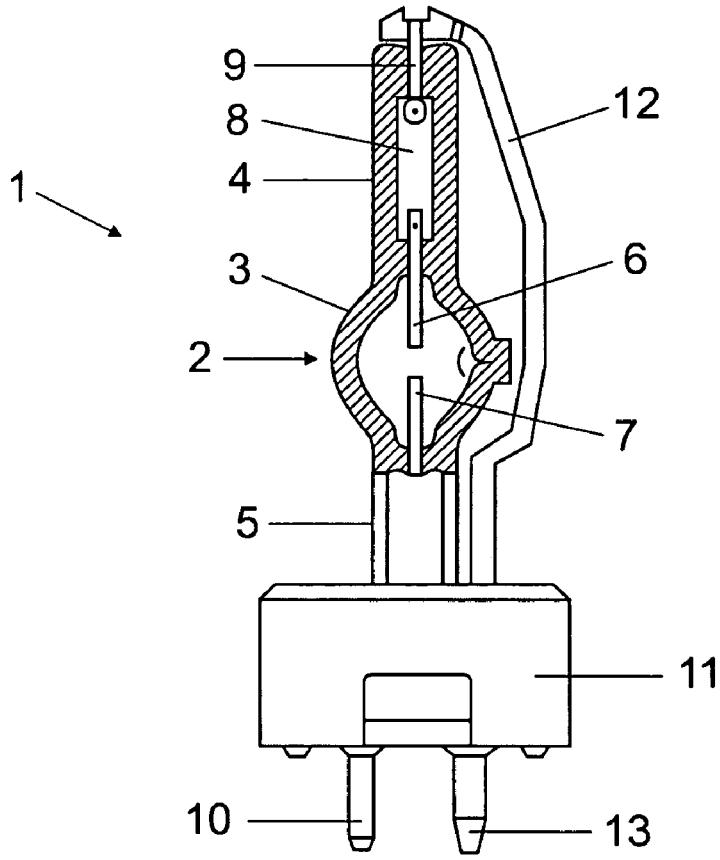

The invention relates to a metal halide high-pressure discharge lamp having a discharge vessel made from light-transmitting material which is stable at high temperatures, two electrodes which are able to withstand high temperatures and a fill comprising mercury, at least one noble gas, cesium and mercury halides, and dysprosium.

BACKGROUND ART

Metal halide high-pressure discharge lamps of this type are used in particular in lighting systems for stage, film and television, where light with color temperatures of between 5000 and 9000 K and very good color rendering in all color temperature ranges is required. More recently, these lamps have also been used in projection technology and effect lighting, albeit with the known limitations in color rendering on account of the short arc spacing.

U.S. Pat. No. 5,323,085 has disclosed mercury vapor high-pressure discharge lamps with halide additions of dysprosium and hafnium. These lamps emit radiation with a color temperature of between 5000 and 9000 K and a general color rendering index Ra of greater than 70, with the color rendering index $R_9$ for the red spectral region reaching values of up to 50.

However, one drawback is that if the hafnium content is too high, these lamps are prone to arc instability. Moreover, when dimming or boosting the lamps, the temperature change in the burner has a considerable influence on the vapor pressure of the rare earth elements, leading to a considerable change in the color temperature and color rendering.

DISCLOSURE OF THE INVENTION

It is an object of the invention to provide a metal halide high-pressure discharge lamp having the abovementioned features with regard to color temperature and color rendering index, in which the abovementioned drawbacks are as far as possible eliminated. The lamp is intended in particular also to improve the color rendering of short-arc lamps with a typically low Ra.

The object is achieved in metal halide high-pressure discharge lamps having a discharge vessel made from light-transmitting material which is stable at high temperatures, two electrodes which are able to withstand high temperatures, a fill comprising mercury, at least one noble gas, cesium and mercury halides, and dysprosium, by the further addition of metallic vanadium.

Vanadium halide has a high vapor pressure even at low temperatures. Therefore, at the standard burner temperatures of these lamps, the vanadium fill which is added has already completely evaporated. The result of this is in particular that very high Ra values are achieved in the saturated red (i.e. with regard to the $R_9$ value), with relatively short arc spacings of between 3 and 6 mm.

The metal halide high-pressure discharge lamp advantageously contains vanadium in a quantity of in each case 0.12 to 3.8, preferably 0.35 to 3.0 μmol per ml of vessel volume.

If the vanadium is also combined with zirconium, it is possible to raise the color temperature in the blue wavelength region, which leads to a further improvement in Ra and $R_9$ values. It is therefore possible to adapt the color temperature, color rendering and light yield to the particular application area by varying the quantities.

Moreover, the combination of vanadium and zirconium greatly reduces the changing color temperature during dimming or boosting, since both halide compounds are completely evaporated and therefore it is impossible for any change in vapor pressure (and therefore change in particle density) to occur in the plasma of the burner during dimming or boosting. Vanadium and also vanadium together with zirconium presumably form cluster-like molecules similarly to hafnium.

In addition to vanadium, the discharge vessel advantageously also contains zirconium in a quantity of in each case 0.05 to 1.0,preferably 0.15 to 0.8 μmol per ml of vessel volume.

The quantity of dysprosium in the metal halide composition of the discharge vessel should advantageously be between 0.3 and 3 μmol per ml of vessel volume. The discharge vessel of the metal halide high-pressure discharge lamp advantageously contains iodine and bromine in a molar ratio of between 0.1 and 4 as halogens for the halide compounds. The quantity of cesium should be at least 0.5 μmol per ml of vessel volume.

Other additions, such as niobium, tin and cerium, which have been tested, did not bring about any improvement in the desired sense.

BRIEF DESCRIPTION OF THE DRAWING(S)

Figure 2:
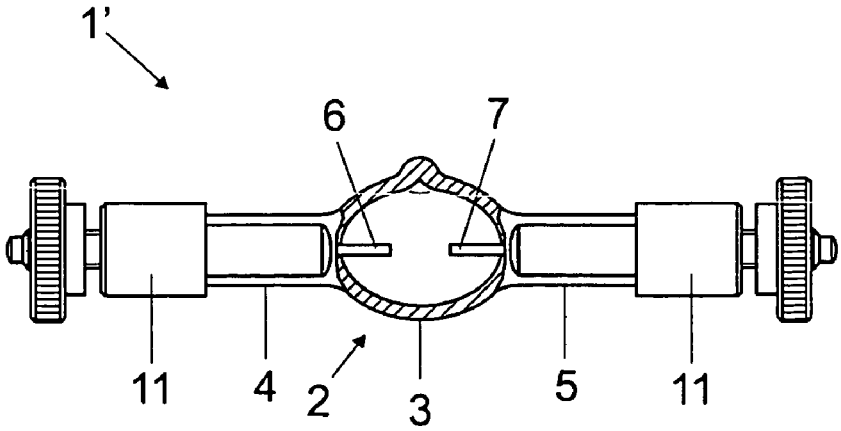

The invention is explained in more detail on the basis of the following exemplary embodiments. In the drawing:

FIG. 1 shows a metal halide high-pressure discharge lamp which is capped on one side, FIG. 2 shows a metal halide high-pressure discharge lamp which is capped on two sides.

BEST MODE FOR CARRYING OUT THE INVENTION

The figures show a partially sectional side view of a metal halide high-pressure discharge lamp 1 according to the invention which is capped on one side or 1' which is capped on two sides, each with a power consumption of 400 W.

The discharge vessel 2 made from quartz glass for the metal halide high-pressure discharge lamp 1 which is capped on one side has a spherical lamp bulb 3 and a lamp neck 4, 5 at each of two diametrically opposite locations, into each of which lamp necks a pin-like tungsten electrode 6, 7 is fused by means of a molybdenum sealing foil 8. Those ends of the sealing foils 8 which are remote from the lamp bulb are welded to supply conductors 9. Whereas one supply conductor is directly connected to a contact pin 10 of the ceramic cap 11, the supply conductor 9 remote from the cap 11 is electrically connected to the other contact pin 13 of the cap 11 via a contact clip 12, which is simultaneously responsible for holding the lamp neck 4 which is remote from the cap.

The discharge vessel 2 of the metal halide high-pressure discharge lamp 1' which is capped on two sides has a similar structure to the discharge vessel of the metal halide high-pressure discharge lamp 1 which is capped on one side. In the case of the metal halide high-pressure discharge lamp 1' which is capped on two sides, however, the supply conductors (not illustrated here) are directly connected to the metallic caps 11 arranged at both free ends of the lamp necks 4, 5.

The table below compiles the quality data for three different fills of the discharge vessel 1 and 1' of the above-mentioned 400 W lamps, two containing vanadium, one containing vanadium and zirconium, as well as the lighting engineering data achieved with the respective fill.

TABLE

| | Lamp 1 (FIG. 1) | Lamp 1' (FIG. 2) | Lamp 1' (FIG. 2) |
|---|---|---|---|
| $HgI_2$ | 0.32 mg | 1.24 mg | 1.25 mg |
| $HgBr_2$ | 1.10 mg | 1.64 mg | 1.64 mg |
| CsBr or CsI | 0.38 mg CsBr | 0.41 mg CsI | 0.41 mg CsI |
| I/Br ratio | 0.18 | 0.77 | 0.77 |
| V | 0.10 mg | 0.05 mg | 0.05 mg |
| Zr | — | — | 0.05 mg |
| Dy | 0.05 mg | 0.24 mg | 0.20 mg |
| Hg | 16 mg | 40 mg | 40 mg |
| Ar/Kr | 200 hPa | 350 hPa | 350 hPa |
| Power consumption | 400 W | 400 W | 400 W |
| Discharge vessel volume | 0.75 ml | 1.40 ml | 1.40 ml |
| Electrode-to-electrode distance | 3.2 mm | 5.5 mm | 5.5 mm |
| Operating voltage | 55 V | 100 V | 100 V |
| Lamp current | 7.3 A | 4.8 A | 4.8 A |
| Color temperature | 5600 K | 5550 K | 6500 K |
| Light yield | 63 lm/W | 80 lm/W | 79 lm/W |
| Color rendering index Ra | 73 | 89 | 95 |
| Red rendering index $R_9$ | 45 | 60 | 92 |
| Service life | 500 h | 750 h | 750 h |

What is claimed is:

1. A metal halide high-pressure discharge lamp comprising: a discharge vessel made from light-transmitting material which is stable at high temperatures, two electrodes which are able to withstand high temperatures and a fill consisting of mercury, at least one noble gas, cesium and mercury halides, and dysprosium, wherein the discharge vessel, to generate light with a color temperature of between 5000 and 9000 K, a general color rendering index Ra of greater than 70 and a color rendering index $R_9$ for the red spectral region of at least 40, additionally contains vanadium as metals for the metal halides.

2. The metal halide high-pressure discharge lamp as claimed in claim 1, wherein the discharge vessel further contains vanadium in a quantity of from 0.12 to 3.8 μmol per ml of vessel volume.

3. The metal halide high-pressure discharge lamp as claimed in claim 2, wherein the discharge vessel further contains vanadium in a quantity of from 0.35 to 3.0 μmol per ml of vessel volume.

4. The metal halide high-pressure discharge lamp as claimed in claim 1, wherein the discharge vessel additionally contains zirconium in a quantity of from 0.05 to 1.0 μmol per ml of vessel volume.

5. The metal halide high-pressure discharge lamp as claimed in claim 4, wherein the discharge vessel additionally contains zirconium in a quantity of in each case 0.15 to 0.8 μmol per ml of vessel volume.

6. The metal halide high-pressure discharge lamp as claimed in claim 1, wherein the discharge vessel further contains dysprosium in a quantity of from 0.3 to 3 μmol per ml of vessel volume.

7. The metal halide high-pressure discharge lamp as claimed in claim 1, wherein the discharge vessel contains iodine and bromine in a molar ratio of between 0.1 and 4 as halogens for the halide compounds.

8. The metal halide high-pressure discharge lamp as claimed in claim 1, wherein the discharge vessel contains cesium in a quantity of at least 0.5 μmol per ml of vessel volume.

* * * * *